US009856709B2

(12) United States Patent
Wesemeier et al.

(10) Patent No.: US 9,856,709 B2
(45) Date of Patent: Jan. 2, 2018

(54) CORING TOOLS INCLUDING CORE SAMPLE FLAP CATCHER AND RELATED METHODS

(71) Applicant: Baker Hughes Incorporated, Houston, TX (US)

(72) Inventors: Christoph Wesemeier, Hannover (DE); Thomas Uhlenberg, Niedersachsen (DE); Sabine Grieschek, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 635 days.

(21) Appl. No.: 14/478,187

(22) Filed: Sep. 5, 2014

(65) Prior Publication Data

US 2015/0068812 A1 Mar. 12, 2015

Related U.S. Application Data

(60) Provisional application No. 61/874,797, filed on Sep. 6, 2013.

(51) Int. Cl.
*E21B 25/10* (2006.01)
*E21B 25/14* (2006.01)
(Continued)

(52) U.S. Cl.
CPC ..... *E21B 25/10* (2013.01); *E21B 10/02* (2013.01); *E21B 25/00* (2013.01); *E21B 25/04* (2013.01); *E21B 25/14* (2013.01)

(58) Field of Classification Search
CPC ..... E21B 10/02; E21B 25/00; E21B 25/10; E21B 25/14
See application file for complete search history.

(56) References Cited

U.S. PATENT DOCUMENTS 2,703,697 A * 3/1955 Walker ..... E21B 25/00 175/245
3,878,904 A 4/1975 Dobson
(Continued)

FOREIGN PATENT DOCUMENTS

EP 0134586 A1 3/1985
EP 0173299 A2 3/1986
(Continued)

OTHER PUBLICATIONS

European Search Report from European Application No. 14841558.8, dated Apr. 10, 2017, 9 pages.
(Continued)

*Primary Examiner* — Cathleen R Hutchins
*Assistant Examiner* — Tara E Schimpf
(74) *Attorney, Agent, or Firm* — TraskBritt

(57) ABSTRACT

A core sample catcher for a coring tool includes at least one flap catcher member movably coupled to an inner barrel of the coring tool. The at least one flap catcher member is configured to move between a first position and a second position. A passageway extending through the inner barrel is at least substantially un-occluded by the at least one flap catcher member in the first position and at least partially occluded by the at least one flap catcher member in the second position. The core sample catcher also includes a piston member located and configured to retain the at least one flap catcher member in the first position. The piston member is sized and configured to release the at least one flap catcher member as the piston is forced upward within the inner barrel by the core sample. Components are provided and assembled to form core sample catchers.

18 Claims, 6 Drawing Sheets

(51) Int. Cl.

| | |
|---|---|
| ***E21B 25/00*** | (2006.01) |
| ***E21B 25/04*** | (2006.01) |
| ***E21B 10/02*** | (2006.01) |

(56) References Cited

U.S. PATENT DOCUMENTS

| | | | | |
|---|---|---|---|---|
| 4,258,803 | A | | 3/1981 | Thompson et al. |
| 4,598,777 | A | * | 7/1986 | Park ..... E21B 25/08 175/226 |
| 4,606,416 | A | | 8/1986 | Knighton et al. |
| 4,607,710 | A | | 8/1986 | Radford |
| 4,930,587 | A | | 6/1990 | Young et al. |
| 5,146,999 | A | | 9/1992 | Wiser et al. |
| 6,116,358 | A | | 9/2000 | Fanuel |
| 2011/0253452 | A1 | | 10/2011 | Beuershausen et al. |
| 2013/0092442 | A1 | | 4/2013 | Zastresek et al. |

FOREIGN PATENT DOCUMENTS

| | | | |
|---|---|---|---|
| JP | 07011860 | A | 1/1995 |
| JP | 11100835 | A | 4/1999 |

OTHER PUBLICATIONS

International Search Report from International Application No. PCT/US2014/054265, dated Dec. 12, 2014, 3 pages.
International Written Opinion from International Application No. PCT/US2014/054265, dated Dec. 12, 2014, 4 pages.

* cited by examiner

CORING TOOLS INCLUDING CORE SAMPLE FLAP CATCHER AND RELATED METHODS

CROSS-REFERENCE TO RELATED APPLICATION

This application claims the benefit of U.S. Provisional Patent Application Ser. No. 61/874,797, filed Sep. 6, 2013, the disclosure of which is hereby incorporated herein in its entirety by this reference.

FIELD

The disclosure relates generally to core sample catchers used in conjunction with coring tools for obtaining core samples from earth formations within a wellbore, and to methods of fabricating and using such core sample catchers and coring tools.

BACKGROUND

When evaluating whether a given earth formation contains valuable materials, such as hydrocarbons, a core sample from the earth formation may be procured using a bottom-hole assembly (BHA) often referred to in the art as a "coring tool." A coring tool generally includes a core bit, which may be a hollow earth-boring rotary drill bit having a longitudinal aperture extending through the center thereof. As a result, when the core bit drills through the formation, a generally cylindrical core sample is formed within the longitudinal aperture extending through the center of the core bit. A substantially non-rotating inner barrel is positioned longitudinally within an outer tubular member, commonly tanned a "core barrel" of the coring tool above the core bit, and is configured and positioned to receive the generally cylindrical core sample therein as the core sample is formed by the core bit as the core bit drills into the earth formation and the coring tool lowers around the core sample.

Once the core bit has drilled a core sample of desirable length, a core catcher is used to fracture the core sample and separate the core sample from the formation near the core bit. The core catcher is typically a collet structure that allows the core sample to pass through the collet into the inner barrel of the coring tool, but that tightens around the core sample when the coring tool is pulled upward away from the bottom of the wellbore to prevent the core sample from backing out from the coring tool through the core catcher. In other words, when the coring tool is pulled upward away from the bottom of the wellbore, the core catcher grips the core sample and generates tensile forces within the core sample below the core catcher that fracture the core sample, allowing it to be retained within the inner barrel and returned to the surface for analysis.

Some formations comprise loose or unconsolidated formation material. For example, some formations may comprise unconsolidated sand. In such formations, a collet type core catcher may not retain all of the core sample within the inner barrel, as the loose formation material may simply fall out of the coring tool through the opening of the core catcher. Other configurations of core catchers have been developed in an effort to retain such unconsolidated formation material within the inner barrel of the coring tool. For example, flap catchers have been developed that include one or more flap members that move between a first open position and a second closed position after a core sample has been formed and received within the inner barrel. The flap catcher substantially covers the central opening in the core bit, which forms the core sample as the core bit drills the formation material around the core sample, and prevents or at least hinders unconsolidated material from falling out from the coring tool as the coring tool is returned to the surface for analysis of the core sample.

BRIEF SUMMARY

In some embodiments, the present disclosure includes a core sample catcher for use with a coring tool for obtaining a core sample from a subterranean formation. The coring tool includes an inner barrel configured to receive a core sample, and the core sample catcher includes at least one flap catcher member movably coupled to the inner barrel of the coring tool. The at least one flap catcher member is configured to move between a first position and a second position, and a passageway extending through the inner barrel is at least substantially un-occluded by the at least one flap catcher member in the first position and at least partially occluded by the at least one flap catcher member in the second position. A piston member is located and configured to retain the at least one flap catcher member in the first position, and the piston member is sized and configured to be forced upward within the inner barrel by the core sample and release the retention of the at least one flap catcher member in the first position by the piston member as the core sample is received within the inner barrel.

In additional embodiments, the present disclosure includes coring tools that include such core sample catchers. For example, a coring tool for use in obtaining a core sample from an earth formation within a wellbore may include a core bit, an outer tubular member coupled to the core bit, and an inner barrel pivotally secured within the outer tubular member above the core bit. The inner barrel is configured to receive a formation core sample therein as the core sample is formed by the core bit as the core bit drills through an earth formation. A core sample catcher as described herein may be coupled to the inner barrel proximate the core bit.

In still other embodiments, the present disclosure includes methods of fabricating such core sample catchers. For example, a method of forming a core sample catcher for use with a coring tool for obtaining a core sample from a subterranean formation may include movably coupling at least one flap catcher member to an inner barrel such that the at least one flap catcher member is configured to move between a first position and a second position. A passageway extending through the inner barrel is at least substantially un-occluded by the at least one flap catcher member in the first position and at least partially occluded by the at least one flap catcher member in the second position. The method may also include disposing a piston member within the coring tool. The piston member retains the at least one flap catcher member in the first position. The piston member may be sized and configured to be forced upward within the inner barrel by the core sample and release the retention of the at least one flap catcher member in the first position by the piston member as the core sample is received within the inner barrel.

BRIEF DESCRIPTION OF THE DRAWINGS

While the disclosure concludes with claims particularly pointing out and distinctly claiming embodiments of the invention, various features and advantages of core sample catchers, coring tools including such core sample catchers, and related methods, as disclosed herein, may be more readily ascertained from the following description when read in conjunction with the accompanying drawings, in which:

DETAILED DESCRIPTION

The illustrations presented herein are not meant to be actual views of any particular core sample catcher, coring tool, or component thereof, but are merely idealized representations employed to describe illustrative embodiments. The figures are not necessarily drawn to scale.

As used herein, the relative term "upward" means and includes in a direction from a core bit toward a surface of a coring operation. Similarly, the relative term "downward" means and includes in a direction from a surface of a coring operation toward a core bit. Likewise, the term "higher" may indicate a position closer to the surface of the coring operation relative to the core bit, and "lower" may indicate a position closer to the core bit relative to the surface of the coring operation.

Figure 1:
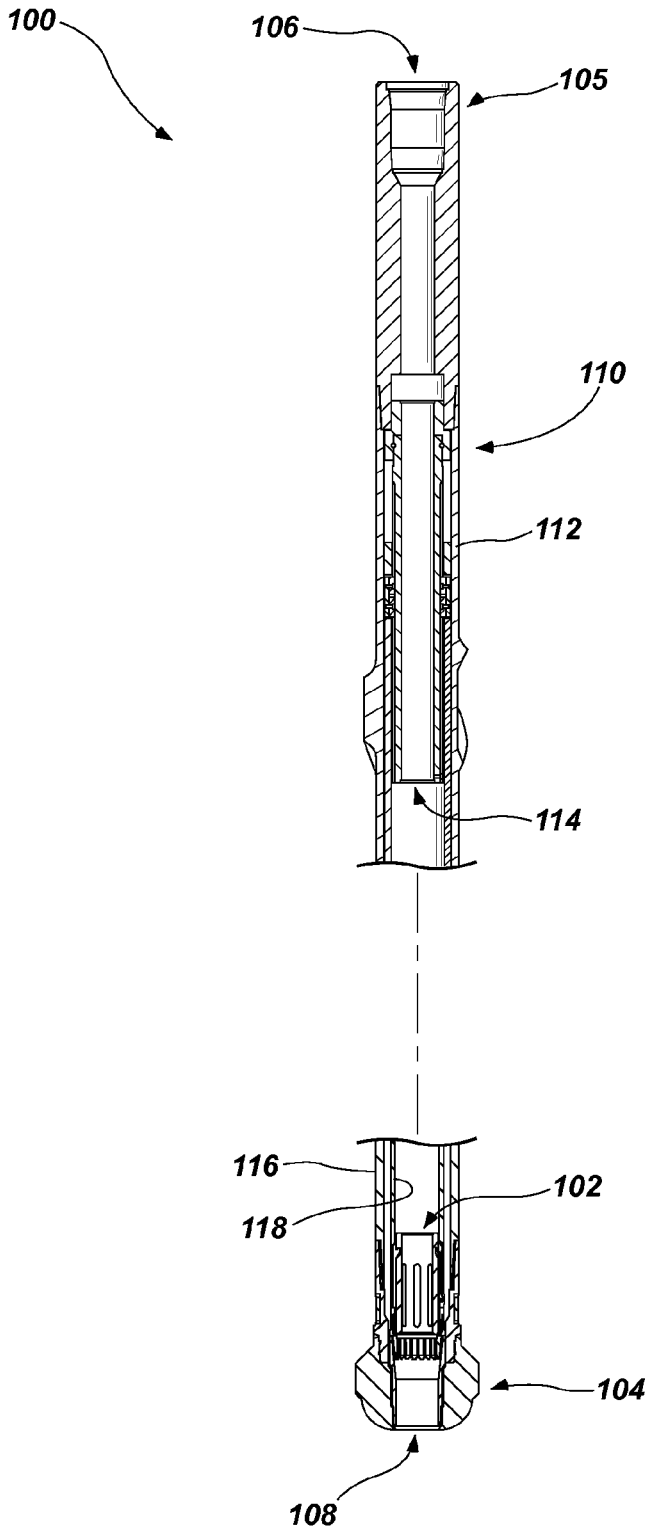
FIG. 1 is a longitudinal cross-sectional view of a coring tool including a core sample catcher and a core bit.

FIG. 1 is a longitudinal cross-sectional view of a coring tool 100 that includes a core sample catcher 102 and a core bit 104. The coring tool 100 has a coupling member 105 at an upper, proximal end 106, and the core bit 104 is disposed at the lower, distal end 108 of the coring tool 100. The coupling member 105 at the upper, proximal end 106 is configured to couple the coring tool 100 to another component of a drill string (not shown), and may be, or include a part of, a swivel member 110.

The swivel member 110 includes an outer tubular member 112 that is fixedly coupled to the coupling member 105, such that outer tubular member 112 rotates in unison with rotation of the coupling member 105 caused by rotation of the drill string. The swivel member 110 also includes an inner assembly 114 supported within the outer tubular member 112 by bearings such that the inner assembly 114 is rotationally decoupled from the outer tubular member 112. Thus, the inner assembly 114 may remain substantially rotationally stationary during rotation of the drill string, coupling member 105, and the outer tubular member 112.

The core bit 104 at the lower distal end 108 of the coring tool 100 may comprise any type or configuration of core bit 104. The core bit 104 is coupled to the outer tubular member 112 of the swivel member 110 by an outer tube 116 comprising one or more tubular segments coupled end-to-end, such that rotation of the outer tubular member 112 of the swivel member 110 (by rotation of the drill string) causes rotation of the core bit 104.

As the core bit 104 is rotated in a coring operation, a generally cylindrical core sample of the formation being drilled is formed within a central opening in the core bit 104. As the core bit 104 drills through the formation and forms the core sample from uncut formation material within the center of the core bit 104, the core sample advances into and relatively upward through the core bit 104 by way of the central opening and into an inner barrel 118 disposed within the outer tube 116. The inner barrel 118 also may comprise one or more tubular segments coupled end-to-end.

During normal operation, the coring operation will continue until a core sample of desirable length has been formed by the core bit 104 and received within the inner barrel 118. The core sample catcher 102 is configured to catch or retain the core sample received in the inner barrel 118 and prevent the core sample from backing out from the coring tool 100, and is used to fracture the core sample and separate the core sample from the formation near the core bit 104. As discussed in further detail below, the core sample catcher 102 may include a flap catcher that is useful for retaining loose or unconsolidated formation material within the inner barrel 118.

Figure 2:
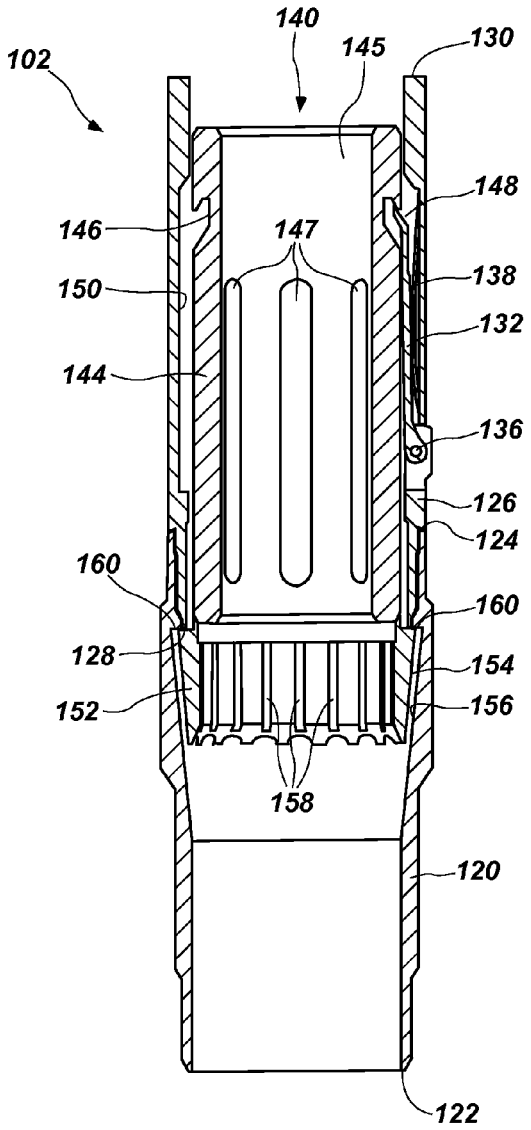
FIG. 2 is an enlarged view of a portion of FIG. 1 illustrating components of the core sample catcher separate from other components of the coring tool, and depicting a movable piston member retaining a flap catcher member in a first open position.

FIG. 2 is an enlarged view of the core sample catcher 102 of the coring tool 100 of FIG. 1 separate from other components of the coring tool 100. The core sample catcher 102 includes a generally tubular shoe 120, and a flap catcher tube 126 coupled to the shoe 120. The shoe 120 has a lower end 122 and an upper end 124. The flap catcher tube 126 has a lower end 128 and an upper end 130. The lower end 128 of the flap catcher tube 126 may be coupled to the upper end 124 of the shoe 120 using threads, for example. The upper end 130 of the flap catcher tube 126 may be configured for coupling to a lower end of the inner barrel 118 of the coring tool 100 (FIG. 1). While the shoe 120 and the flap catcher tube 126 are described above and shown in the figures as two individual parts coupled with the inner barrel 118, those skilled in the art will appreciate that the shoe 120 and the flap catcher tube 126 may comprise one integral part, i.e., a unitary structure. Furthermore, in some embodiments, the shoe 120, the flap catcher tube 126, and the inner barrel 118 may similarly comprise a unitary structure. Thus, the shoe 120 and the flap catcher tube 126 may be characterized as the inner barrel 118 or as portions of the inner barrel 118.

Figure 3:
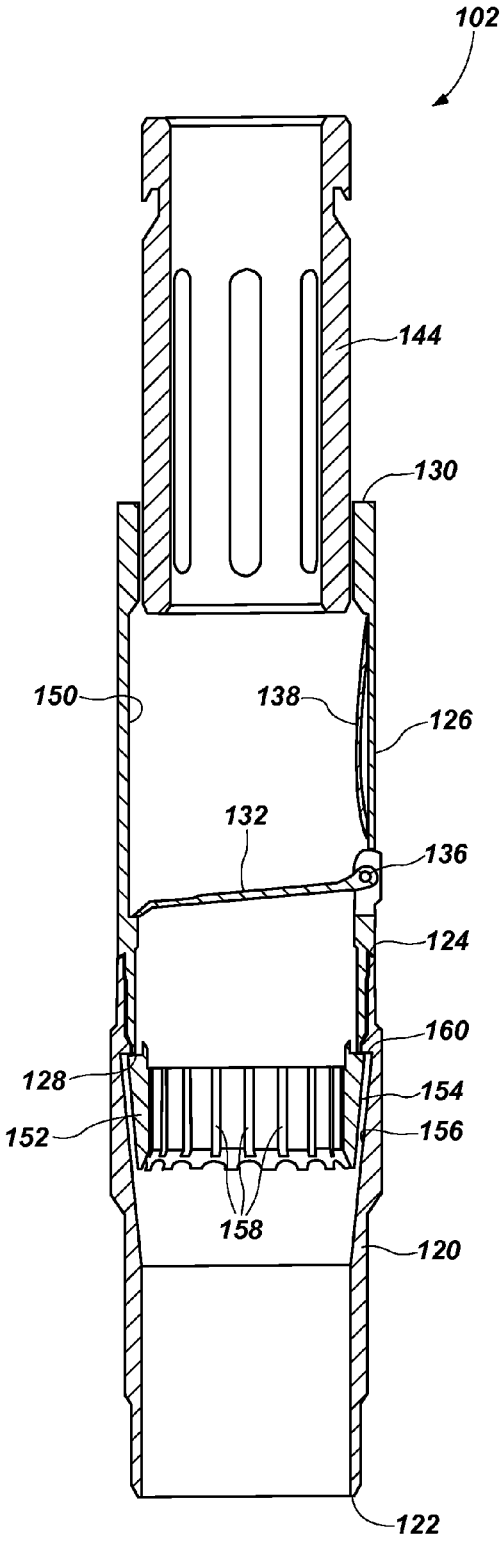
FIG. 3 is similar to FIG. 2, but depicts the piston member displaced upwardly from the position of FIG. 2 and the flap catcher member in a second closed position.

At least one flap catcher member 132 is disposed within the flap catcher tube 126. Although only one flap catcher member 132 is illustrated in the embodiment of FIGS. 2 and 3, the core sample catcher 102 may include two or more such flap catcher members 132 in additional embodiments. The flap catcher member 132 is movably coupled to a wall of the flap catcher tube 126 and configured to move between a first open position (shown in FIG. 2) and a second closed position (shown in FIG. 3). The flap catcher member 132 may be movably coupled to the wall of the flap catcher tube 126 using, for example, a hinge 136. As a non-limiting example, the hinge 136 may include a pinned connection, as shown in FIG. 2. In other embodiments, the hinge 136 may include an elastic member coupled to or integrally formed with the flap catcher member 132.

As shown in FIG. 2, a passageway 140 extends longitudinally through the core sample catcher 102. The passageway 140 is at least substantially un-occluded by the flap catcher member 132 when the flap catcher member 132 is in the first open position shown in FIG. 2. The passageway 140 is at least partially occluded by the flap catcher member 132 (FIG. 3) when the flap catcher member 132 is in the second closed position shown in FIG. 3 so as to retain core sample material within the inner barrel 118 (FIG. 1) of the coring tool 100.

The core sample catcher 102 of the coring tool 100 may further include a spring member 138 that is located and configured to bias the flap catcher member 132 toward the second closed position of FIG. 3. The spring member 138 may be disposed between the flap catcher member 132 and the wall of the flap catcher tube 126. In some embodiments, the spring member 138 may comprise a leaf spring. In other embodiments, the spring member 138 may be a coil spring or other spring configuration. In some embodiments, the spring member 138 may be coupled only to the wall of the flap catcher tube 126 and configured to bear against the flap catcher member 132. In other embodiments, the spring member 138 may be coupled to both the wall of the flap catcher tube 126 and the flap catcher member 132. In yet other embodiments, the spring member 138 may be coupled only to the flap catcher member 132, and configured to bear against the wall of the flap catcher tube 126. In still other embodiments, a protrusion (not shown) may be located between the wall of the flap catcher tube 126 and the flap catcher member 132 and the flap catcher member 132 may be elastically bent over the protrusion when in the first position, so that it is biased towards the second position by elastic strain of the flap catcher member material.

With continued reference to FIG. 2, the core sample catcher 102 further includes a piston member 144. The piston member 144 may be initially disposed within the flap catcher tube 126, and may be located and configured to retain the flap catcher member 132 in the first open position shown in FIG. 2 until a core sample of a formation is received within the coring tool 100, as described in further detail below with reference to FIGS. 4 through 7. In particular, the piston member 144 may be sized and configured to be forced upward within the flap catcher tube 126, so as to release the retention of the flap catcher member 132 in the first open position, by a core sample as the core sample is received within the flap catcher tube 126. The piston member 144 may include one or more openings from its upper end to its lower end to allow the flap catcher member 132 to be retained in the first open position shown in FIG. 2, without occluding the fluid passageway 140 through the core sample catcher 102. For example, the piston member 144 may include a central bore 145 extending through a central portion of the piston member 144. As a result, the inner barrel 118 (FIG. 1) of the coring tool 100 may be flushed with fluid while "tripping" the coring tool 100 into the wellbore. In some embodiments, fluid may be actively pumped through the inner barrel 118 to wash formation cuttings or other foreign particulate matter out from the inner barrel 118 until the coring operation is started. In some embodiments, the piston member 144 may also include one or more apertures 147 that allow a fluid flowing through the central bore 145 to flow from the central bore 145, through the one or more apertures 147, and flush an exterior of the piston member 144. The central bore 145 in the piston member 144 may be sized and configured to create minimal resistance to a flow of fluid through the inner barrel 118. For example, the flow resistance of the piston member 144 may be low enough that flow of fluid through the piston member 144 during normal operation does not cause undesired movement of the piston member 144. Retaining the flap catcher member 132 in the first position by the piston member 144 allows flushing the inner barrel 118 with fluid before the coring operation starts without requiring openings in the flap catcher member 132. Openings in the flap catcher member 132 are undesirable because core material may fall through the openings in the flap catcher member 132, and part of the core sample might be lost while tripping the coring tool 102 out of the hole. The piston member 144 may also reduce the likelihood of damage to a core sample 202 (FIG. 5), the flap catcher member 132, the hinge 136, or the spring member 138 that may occur if the flap catcher member 132 were in an initially closed position (FIG. 3) and were forced open by the entry of a core sample (e.g., core sample 202 in FIG. 5). Furthermore, forced opening of the flap catcher member 132 by a core sample 202 entering the inner barrel 118 may also increase the likelihood of the core sample 202 jamming within the inner barrel 118.

As shown in FIGS. 2 and 3, the flap catcher member 132 and the piston member 144 may have interacting features configured to prevent the piston member 144 from moving in the downward direction through the shoe 120. For example, such interacting features may comprise a recess 146 in an outer side surface of the piston member 144, and a complementary projection 148 on the flap catcher member 132 that extends at least partially into the recess 146, as shown in FIG. 2. The recess 146 and the projection 148 may have shapes that are sized, located, and otherwise configured to allow the projection 148 of the flap catcher member 132 to slide out from the recess 146 in the flap catcher tube 126 responsive to longitudinally upward movement of the piston member 144 within the flap catcher tube 126, and to prevent the projection 148 of the flap catcher member 132 from sliding out from the recess 146 in the flap catcher tube 126 responsive to longitudinally downward movement of the piston member 144 within the flap catcher tube 126.

For example, the recess 146 may extend into the wall of the piston member 144 at an acute angle to the longitudinal axis of the fluid passageway 140 extending through the core sample catcher 102. The complementary projection 148 of the flap catcher member 132 also may be oriented at substantially the same acute angle to the longitudinal axis of the fluid passageway 140. The orientation of the acute angle may be such that downward movement of the piston member 144 is precluded, while upward movement of the piston member 144 is enabled.

A recess 150 also may be formed in the inner surface of the wall of the flap catcher tube 126, and the recess 150 may be sized and located to allow the flap catcher member 132 to move into the recess 150 as the piston member 144 slides upwardly within the flap catcher tube 126. The recess 150 may extend circumferentially around the inner surface of the wall of the flap catcher tube 126. A central axis of the recess 150 may be coaxial with a longitudinal axis of the inner barrel 118, or the central axis of the recess 150 may be offset with respect to the longitudinal axis of the inner barrel 118. Some embodiments of the core sample catcher 102 may not include any recess 150. In other embodiments, the flap catcher tube 126 may include multiple recesses.

A float sub housing a float valve (i.e., a back pressure valve) preventing drilling fluid from backflowing upwardly through the coring tool 100, may be connected to the coring tool 100 or the bottom-hole assembly (BHA) above the coring tool 100 to prevent the piston member 144 from moving in the upward direction within the coring tool 100 until the piston member 144 is moved upwardly by a core sample entering the core sample catcher 102.

In some embodiments, the core sample catcher 102 may further include a core catcher 152, e.g., a collet catcher or a spring catcher. The core catcher 152 may be configured to allow a core sample to pass through the core catcher 152, through the flap catcher tube 126, and into the inner barrel 118 of the coring tool 100. The core catcher 152 may also be configured to tighten around the core sample when the coring tool 100 is pulled upward away from the bottom of the wellbore to prevent the core sample from backing out from the coring tool 100 through the core catcher 152. Thus, the core catcher 152 grips the core sample and generates tensile forces within the core sample below the core catcher 152 that fracture the core sample when the coring tool 100 is pulled upward away from the bottom of the wellbore. The portion of the core sample within the coring tool 100 then may be retained within the inner barrel 118 and returned to the surface for analysis.

As shown in FIGS. 2 and 3, the core catcher 152 may be disposed within the shoe 120. The core catcher 152 may have a tapered outer side surface 154, and the shoe 120 may have a complementary tapered inner side surface 156 disposed adjacent the tapered outer side surface 154 of the core catcher 152. The tapered outer side surface 154 and the tapered inner side surface 156 may be disposed at an acute angle to a longitudinal axis of the fluid passageway 140, and the acute angle may be oriented such that, as the core catcher 152 is forced downwardly within the shoe 120 or the shoe 120 is forced upwardly with respect to the core catcher 152, the interaction between the tapered outer side surface 154 of the core catcher 152 and the tapered inner side surface 156 of the shoe 120 generates stress and corresponding strain within the core catcher 152 in the radially inward direction, such that any core sample within the core catcher 152 is squeezed by the core catcher 152. Grooves 158 may be formed on inner and/or outer surfaces of the core catcher 152, to enhance the compressive strain of the core catcher 152 and the grip of the core catcher 152 on any core sample within the core catcher 152 when the core catcher 152 is in a state of radially inward compressive strain. The inner diameter of the core catcher 152 may be smaller than an outer diameter of a core sample (e.g., core sample 202 in FIG. 5) cut by the core bit 104 (FIG. 1) so that interference between the core sample 202 cut by the core bit 104 and the core catcher 152 ensures that the tapered outer side surface 154 of the core catcher 152 is seated securely against the tapered inner side surface 156 of the shoe 120 when the coring tool is removed from the borehole. As a non-limiting example, the grooves 158 may be gaps between built-up areas of hardfacing material.

The core catcher 152 may abut against a radially, inwardly projecting shoulder 160 formed on the inner surface of the shoe 120 that prevents the core catcher 152 from moving in the upward direction within the shoe 120 beyond the shoulder 160. The piston member 144 may be disposed at least partly inside the core catcher 152 before the core starts to enter and pass through the core catcher 152. Interference between the piston member 144 and the core catcher 152 when the piston member 144 is disposed within the core catcher 152 may create stress and a corresponding strain that increases the inside diameter of the core catcher 152. Increasing the inside diameter of the core catcher 152 in this manner may enable the core sample 202 (FIG. 5) to enter the inside diameter of the core catcher 152 without colliding with the core catcher 152. As the core sample 202 pushes the piston member 144 upward out of the core catcher 152, the strain may be relieved, and the core catcher 152 may constrict around the core sample 202. Interference and friction between the core catcher 152 and the piston member 144 may prevent the piston from unintended movement in response to fluid flow.

Figure 4:
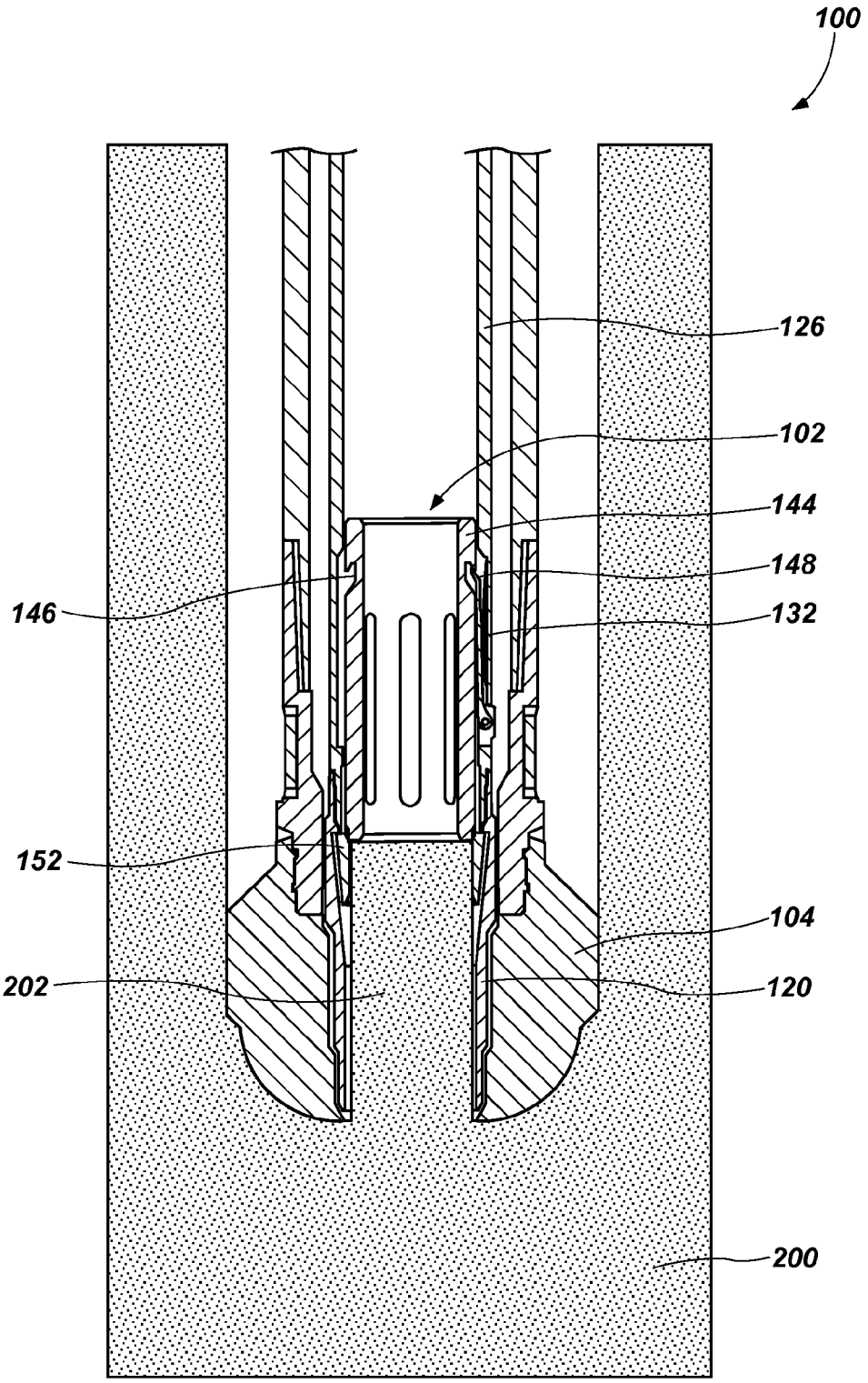
FIG. 4 is a simplified cross-sectional side view of the coring tool of FIG. 1 drilling through a formation to form a core sample, wherein the core sample has passed through a core catcher and is abutting against a piston member.

FIGS. 4 through 7 are simplified depictions of the coring tool 100 in operation. As shown in FIG. 4, upon commencing a coring operation in a subterranean formation 200, rotation of the core bit 104 will result in formation of a generally cylindrical core sample 202 within a central opening extending through core bit 104 and within the shoe 120 of the core sample catcher 102. While FIGS. 4 through 7 show the lower end of the shoe 120 at the same depth as the face of the core bit 104, those skilled in the art will appreciate that the lower end of the shoe 120 may be located at some distance above the face of the core bit 104. The piston member 144 is disposed within the flap catcher tube 126, and retains the flap catcher member 132 in the first open position (FIG. 2). Additionally, the projection 148 of the flap catcher member 132 is disposed within the recess 146 in the piston member 144 (as shown in FIG. 2) to prevent downward movement of the piston member 144 within the core sample catcher 102. As shown in FIG. 4, the top of the core sample will pass through the core catcher 152 and impinge upon a bottom surface of the piston member 144. The internal diameter of the piston member 144 may be smaller than an internal diameter of the core catcher 152 to ensure that the core sample 202 will bear against the lower surface of the piston member 144.

Figure 5:
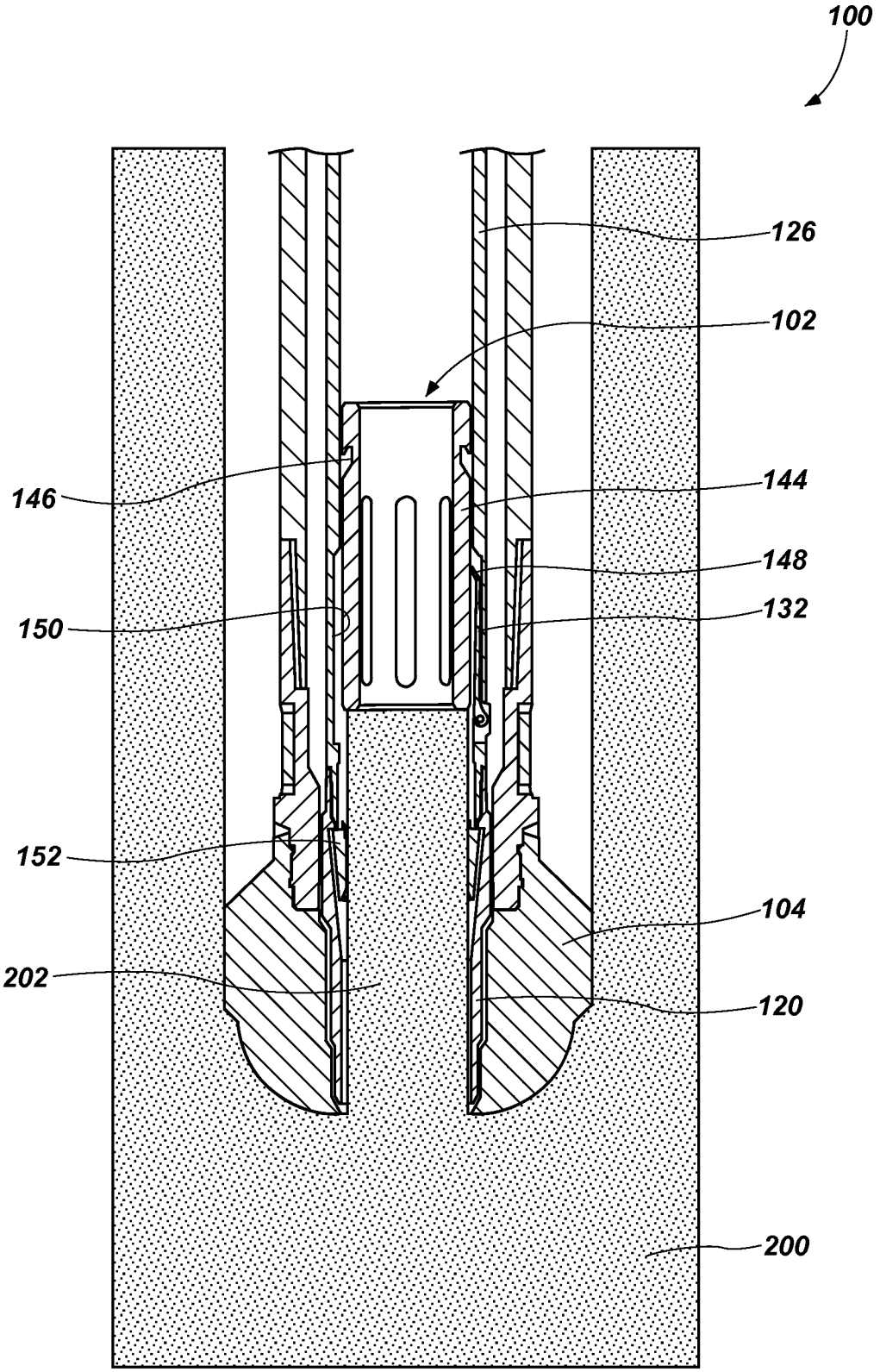
FIG. 5 is similar to FIG. 4 and illustrates the core sample pushing the piston member upward within the coring tool.
Figure 6:
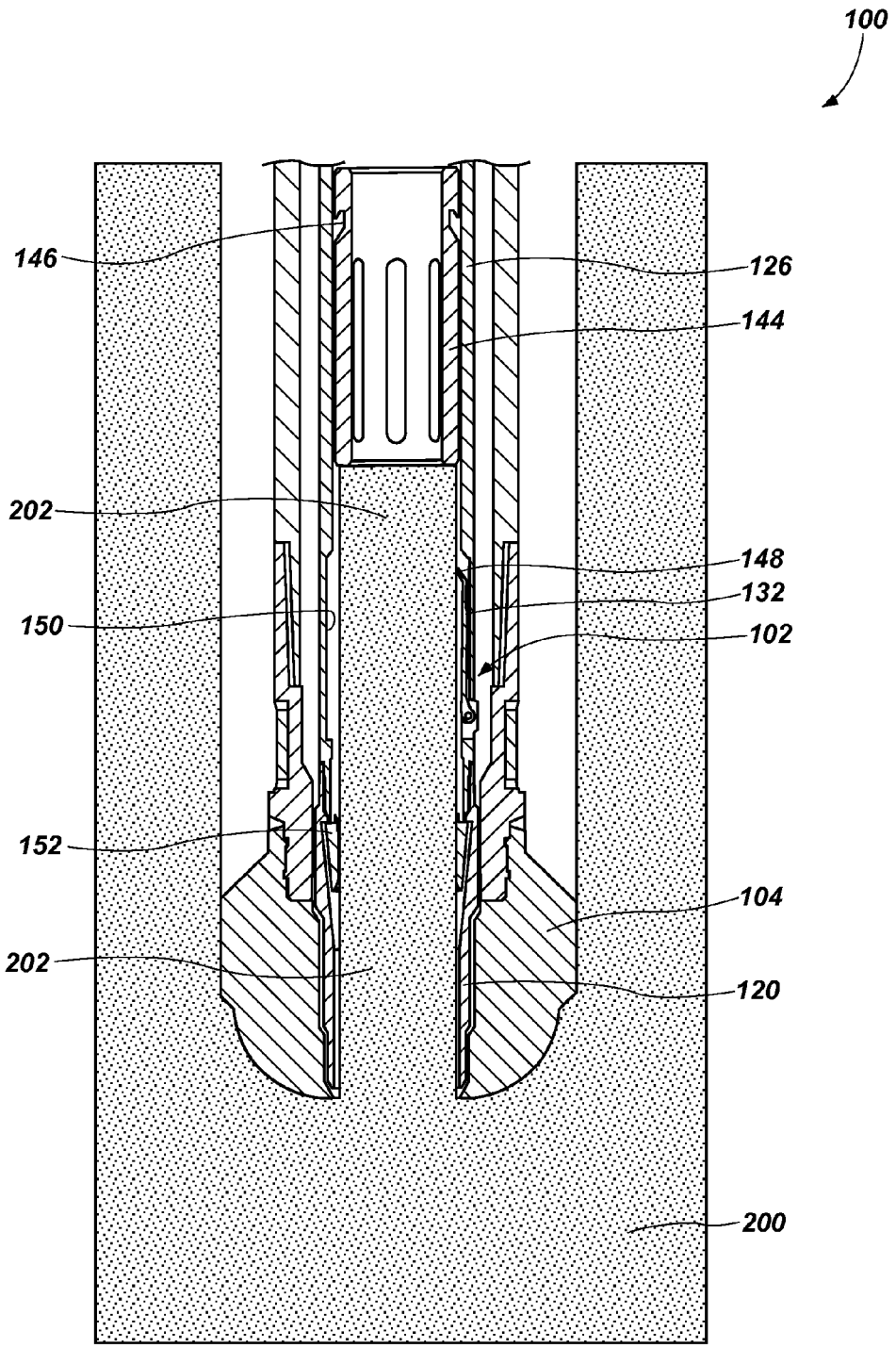
FIG. 6 is similar to FIG. 5 and illustrates the core sample pushing the piston member further upward within the coring tool.

Referring to FIG. 5, as the core bit 104 advances through the formation 200, the length of the core sample 202 increases, and the core sample 202 extends a further distance into the coring tool 100. In the position shown in FIG. 5, the top of the core sample 202 had pushed the piston member 144 upward within the flap catcher tube 126 to a position at which the flap catcher member 132 is disposed laterally adjacent the piston member 144, but the projection 148 of the flap catcher member 132 has been forced out from the recess 146 in the outer surface of the piston member 144. Thus, the flap catcher member 132 has been displaced by the piston member 144 into the recess 150 formed in the inner side surface of the flap catcher tube 126 so as to allow the core sample 202 to pass by the flap catcher member 132 as the core sample 202 is received into the coring tool 100, as shown in FIG. 6. The recess 150 in the figures is shown to be axis symmetric and concentric with the outer surface of the flap catcher tube 126. However, in other embodiments, one or more recesses which are not axis symmetric or not concentric with the outer surface of the flap catcher tube 126 may provide the same functionality. The spring member 138 (FIG. 7) may hold the flap catcher member 132 against the side of the core sample 202 as the core sample 202 passes by the flap catcher member 132.

Figure 7:
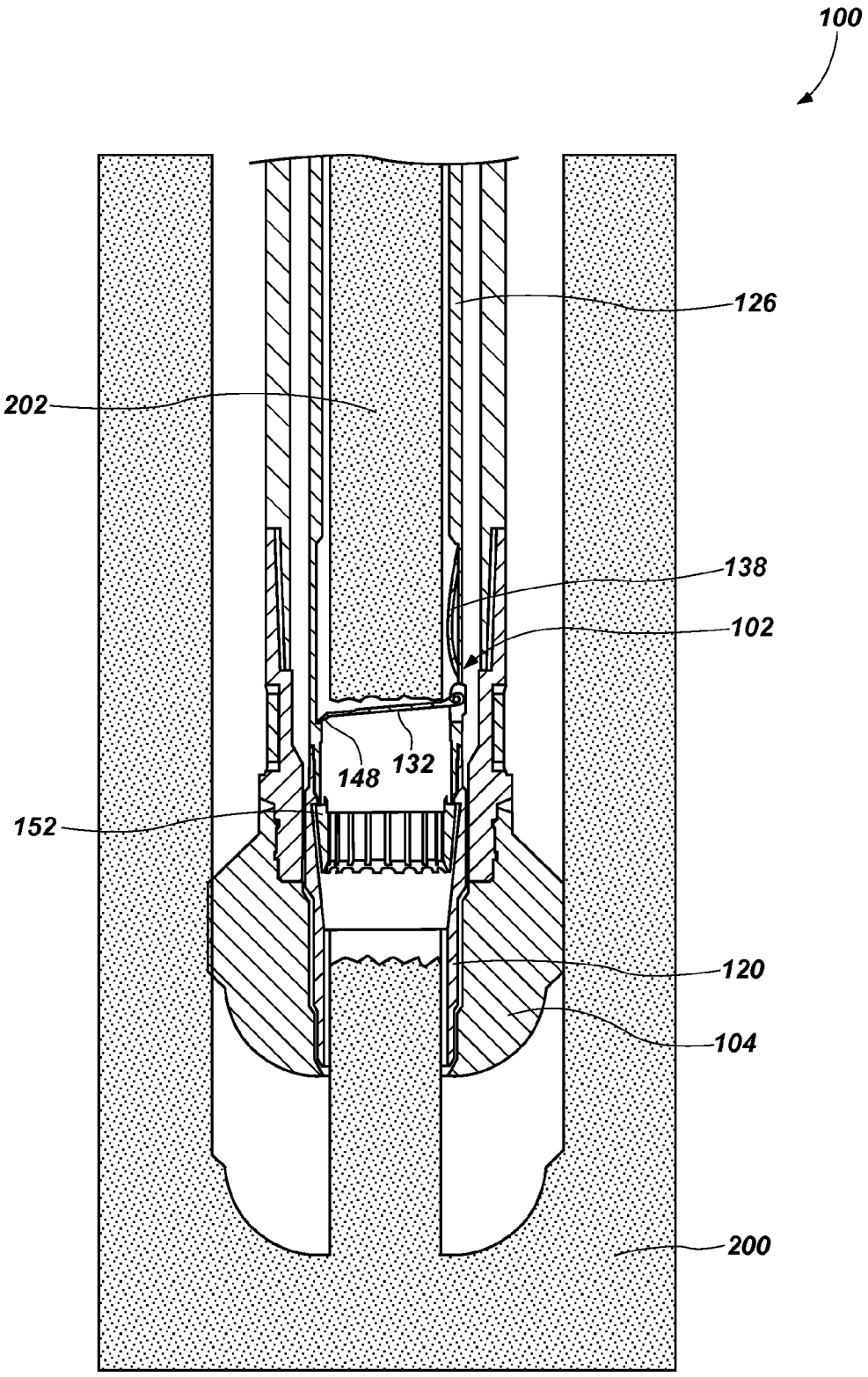
FIG. 7 is similar to FIGS. 4 through 6 and illustrates the core sample received within the coring tool and a flap catcher member retaining the core sample within the coring tool.

As shown in FIG. 7, when a core sample 202 of sufficient length has been received through the core sample catcher 102 and into the inner barrel 118 (FIG. 1) of the coring tool 100, the coring tool 100 may be pulled upwardly within the wellbore. If the core is stable, (i.e., consolidated formation material) pulling upwardly on the coring tool 100 within the wellbore causes the core catcher 152 to constrict around the core sample 202, generating tensile forces that will result in fracture of the core sample 202 proximate the core catcher 152 and separation of the core sample 202 from the formation 200. The core sample 202 is held by the core catcher 152 while the coring tool 100 moves to the surface. However, if the core sample 202 is unstable (i.e., unconsolidated formation material), the core sample 202 may disintegrate and fall from the flap catcher tube 126 of the inner tube shoe 120 because of its higher density relative to the fluid inside the coring tool 100. In this case, the flap catcher member 132 will be moved through the unconsolidated formation material (potentially initiated by the optional spring member 138)

to the closed position. The flap catcher member 132 serves to retain the core sample 202 and any loose or unconsolidated formation material within the inner barrel 118 (FIG. 1) while the coring tool 100 is returned to the surface of the formation for analysis of the core sample 202.

Additional, non-limiting embodiments within the scope of this disclosure include:

Embodiment 1

A core sample catcher for use with a coring tool for obtaining a core sample from a subterranean formation, the coring tool comprising an inner barrel configured to receive a core sample, the core sample catcher comprising: at least one flap catcher member movably coupled to the inner barrel of the coring tool, the at least one flap catcher member configured to move between a first position and a second position, a passageway extending through the inner barrel being at least substantially un-occluded by the at least one flap catcher member in the first position and at least partially occluded by the at least one flap catcher member in the second position; and a piston member located and configured to retain the at least one flap catcher member in the first position, the piston member sized and configured to be forced upward within the inner barrel by the core sample and release the retention of the at least one flap catcher member in the first position by the piston member as the core sample is received within the inner barrel.

Embodiment 2

The core sample catcher of Embodiment 1, wherein the piston member comprises a central bore disposed in the passageway of the coring tool.

Embodiment 3

The core sample catcher of Embodiment 2, wherein the piston member comprises one or more apertures in a wall of the piston to allow at least a portion of a drilling fluid flowing through the central bore to flush an exterior surface of the piston member.

Embodiment 4

The core sample catcher of any one of Embodiments 1 through 3, further comprising a spring member configured to bias the at least one flap catcher member toward the second position.

Embodiment 5

The core sample catcher of Embodiment 4, wherein the spring member comprises a portion of the flap catcher member comprising a resilient material.

Embodiment 6

The core sample catcher of any one of Embodiments 1 through 5, further comprising a core catcher disposed inside the inner barrel.

Embodiment 7

The core sample catcher of Embodiment 6, wherein at least a portion of the piston member is disposed at least partly within a portion of the core catcher prior to beginning a coring operation.

Embodiment 8

The core sample catcher of any one of Embodiments 1 through 7, wherein the at least one flap catcher member and the piston member have interacting features configured to prevent the piston member from moving in a downward direction.

Embodiment 9

A coring tool for use in obtaining a core sample from an earth formation within a wellbore, comprising: a core bit; an outer tubular member coupled to the core bit and an inner barrel pivotally secured within the outer tubular member above the core bit, the inner barrel configured to receive a formation core sample therein as the core sample is formed by the core bit as the core bit drills through an earth formation; and a core sample catcher coupled to the inner barrel proximate the lower end of the inner barrel, the core sample catcher comprising: at least one flap catcher member movably coupled to the inner barrel, the at least one flap catcher member configured to move between a first position and a second position, a passageway extending through the inner barrel being at least substantially un-occluded by the at least one flap catcher member in the first position and at least partially occluded by the at least one flap catcher member in the second position; and a piston member located and configured to retain the at least one flap catcher member in the first position, the piston member sized and configured to be forced upward within the inner barrel by the core sample and release the retention of the at least one flap catcher member in the first position by the piston member as the core sample is received within the inner barrel.

Embodiment 10

The coring tool of Embodiment 9, wherein the piston member comprises a central bore disposed in the passageway of the coring tool.

Embodiment 11

The coring tool of Embodiment 10, wherein the piston member comprises one or more apertures in a wall of the piston to allow at least a portion of a drilling fluid flowing through the central bore to flush an exterior surface of the piston member.

Embodiment 12

The coring tool of Embodiment 10 or Embodiment 11, further comprising a spring member configured to bias the at least one flap catcher member toward the second position.

Embodiment 13

The coring tool of Embodiment 12, wherein the spring member comprises a portion of the flap catcher member comprising a resilient material.

Embodiment 14

The coring tool of any one of Embodiments 9 through 13, wherein the core sample catcher further comprises a core catcher disposed inside the inner barrel.

Embodiment 15

The coring tool of Embodiment 14, wherein the piston member is disposed at least partly within a portion of the core catcher prior to beginning a coring operation.

Embodiment 16

The coring tool of any one of Embodiments 9 through 15, wherein the at least one flap catcher member and the piston member have interacting features configured to prevent the piston member from moving downward through the inner barrel.

Embodiment 17

A method of forming a core sample catcher for use with a coring tool for obtaining a core sample from a subterranean formation, the method comprising: movably coupling at least one flap catcher member to an inner barrel such that the at least one flap catcher member is configured to move between a first position and a second position, a passageway extending through the inner barrel being at least substantially un-occluded by the at least one flap catcher member in the first position and at least partially occluded by the at least one flap catcher member in the second position; and disposing a piston member within the coring tool, to retain the at least one flap catcher member in the first position using the piston member, the piston member sized and configured to be forced upward within the inner barrel by the core sample and release the retention of the at least one flap catcher member in the first position by the piston member as the core sample is received within the inner barrel.

Embodiment 18

The method of Embodiment 17, further comprising providing a core catcher within the inner barrel.

Embodiment 19

The method of Embodiment 18, further comprising disposing the piston member at least partly inside the core catcher.

Embodiment 20

The method of Embodiment 19, wherein disposing the piston member at least partly inside the core catcher comprises elastically increasing an inside diameter of the core catcher by interference between the piston member and the inside diameter of the core catcher.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A coring tool for obtaining a core sample from a subterranean formation, the coring tool comprising a core sample catcher and an inner barrel configured to receive a core sample, the core sample catcher comprising:

at least one flap catcher member movably coupled to the inner barrel of the coring tool, the at least one flap catcher member configured to move between a first position and a second position, a passageway extending through the inner barrel being at least substantially un-occluded by the at least one flap catcher member in the first position and at least partially occluded by the at least one flap catcher member in the second position; and a piston member comprising a central bore disposed in the passageway of the coring tool, the piston member located and configured to retain the at least one flap catcher member in the first position, the piston member sized and configured to be forced upward within the inner barrel by the core sample and release the retention of the at least one flap catcher member in the first position by the piston member as the core sample is received within the inner barrel.

2. The core sample catcher of claim 1, wherein the piston member comprises one or more apertures in a wall of the piston member to allow at least a portion of a drilling fluid flowing through the central bore to flush an exterior surface of the piston member.

3. The core sample catcher of claim 1, further comprising a spring member configured to bias the at least one flap catcher member toward the second position.

4. The core sample catcher of claim 3, wherein the spring member comprises a portion of the flap catcher member.

5. The core sample catcher of claim 1, further comprising a core catcher disposed inside the inner barrel.

6. The core sample catcher of claim 5, wherein at least a portion of the piston member is disposed at least partly within a portion of the core catcher prior to beginning a coring operation.

7. The core sample catcher of claim 1, wherein the at least one flap catcher member and the piston member have interacting features configured to prevent the piston member from moving in a downward direction.

8. A coring tool for use in obtaining a core sample from an earth formation within a wellbore, comprising:

a core bit;

an outer tubular member coupled to the core bit and an inner barrel rotationally secured within the outer tubular member above the core bit, the inner barrel configured to receive a formation core sample therein as the core sample is formed by the core bit as the core bit drills through an earth formation; and a core sample catcher coupled to the inner barrel proximate the lower end of the inner barrel, the core sample catcher comprising:

at least one flap catcher member movably coupled to the inner barrel, the at least one flap catcher member configured to move between a first position and a second position, a passageway extending through the inner barrel being at least substantially un-occluded by the at least one flap catcher member in the first position and at least partially occluded by the at least one flap catcher member in the second position; and a piston member comprising a central bore disposed in the passageway of the coring tool, the piston member located and configured to retain the at least one flap catcher member in the first position, the piston member sized and configured to be forced upward within the inner barrel by the core sample and release the retention of the at least one flap catcher member in the first position by the piston member as the core sample is received within the inner barrel.

9. The coring tool of claim 8, wherein the piston member comprises one or more apertures in a wall of the piston to allow at least a portion of a drilling fluid flowing through the central bore to flush an exterior surface of the piston member.

10. The coring tool of claim 8, further comprising a spring member configured to bias the at least one flap catcher member toward the second position.

11. The coring tool of claim 10, wherein the spring member comprises a portion of the flap catcher member.

12. The coring tool of claim 8, wherein the core sample catcher further comprises a core catcher disposed inside the inner barrel.

13. The coring tool of claim 12, wherein the piston member is disposed at least partly within a portion of the core catcher prior to beginning a coring operation.

14. The coring tool of claim 9, wherein the at least one flap catcher member and the piston member have interacting features configured to prevent the piston member from moving downward through the inner barrel.

15. A method of forming a core sample catcher for use with a coring tool for obtaining a core sample from a subterranean formation, the method comprising:

movably coupling at least one flap catcher member to an inner barrel such that the at least one flap catcher member is configured to move between a first position and a second position, a passageway extending through the inner barrel being at least substantially un-occluded by the at least one flap catcher member in the first position and at least partially occluded by the at least one flap catcher member in the second position; and disposing a piston member within the coring tool, to retain the at least one flap catcher member in the first position using the piston member, the piston member comprising a central bore in the passageway of the coring tool, the piston member sized and configured to be forced upward within the inner barrel by the core sample and release the retention of the at least one flap catcher member in the first position by the piston member as the core sample is received within the inner barrel.

16. The method of claim 15, further comprising providing a core catcher within the inner barrel.

17. The method of claim 16, further comprising disposing the piston member at least partly inside the core catcher.

18. The method of claim 17, wherein disposing the piston member at least partly inside the core catcher comprises elastically increasing an inside diameter of the core catcher by interference between the piston member and the inside diameter of the core catcher.

* * * * *